US005284186A

United States Patent [19]

Bontshek

[11] Patent Number: 5,284,186

[45] Date of Patent: Feb. 8, 1994

[54] HAND WEAVING FRAME FOR FORMING A FLOOR MAT

[75] Inventor: Sholem Bontshek, Melbourne, Australia

[73] Assignee: Intermart USA Corporation, Miami, Fla.

[21] Appl. No.: 998,288

[22] Filed: Dec. 30, 1992

[51] Int. Cl.[5] ..... D03D 29/00

[52] U.S. Cl. ..... 139/34; 28/151; 28/152

[58] Field of Search ..... 28/149, 150, 151, 152; 139/34

[56] References Cited

U.S. PATENT DOCUMENTS

| | | | |
|---|---|---|---|
| 333,942 | 1/1886 | Greenland . | |
| 423,659 | 3/1890 | Bollentin . | |
| 482,980 | 9/1892 | Marshall . | |
| 685,916 | 5/1901 | Gawne et al. . | |
| 688,140 | 12/1901 | Weil . | |
| 910,332 | 1/1909 | Wattie . | |
| 933,869 | 9/1909 | Gruikshank . | |
| 1,190,221 | 7/1916 | Daugherty . | |
| 1,245,997 | 11/1917 | Bailey . | |
| 1,304,518 | 5/1919 | Derbeck . | |
| 1,392,333 | 10/1921 | Jackson . | |
| 1,540,595 | 6/1925 | Brauer | 28/151 |
| 1,675,881 | 7/1928 | Denney | 28/151 |
| 1,686,303 | 10/1928 | Wattie . | |
| 1,854,193 | 4/1932 | Hopkinson . | |
| 2,065,498 | 12/1936 | Bacheller | 28/151 |
| 3,800,372 | 4/1974 | Daoust | 28/152 |
| 4,192,046 | 3/1980 | Meevis et al. | 139/34 X |

FOREIGN PATENT DOCUMENTS

| | | | |
|---|---|---|---|
| 1003305 | 1/1977 | Canada | 28/151 |
| 670826 | 12/1929 | France | 139/34 |
| 258565 | 12/1948 | Switzerland | 139/34 |

*Primary Examiner*—Andrew M. Falik
*Attorney, Agent, or Firm*—Pennie & Edmonds

[57] ABSTRACT

A mat is produced from a single length of rope or other flexible member using a holder assembly which releasably clamps an end of each of a plurality of hollow tubular members. Warp lengths are formed over the clamped tubular members by alternately weaving the lead end of the flexible member over and under adjacent tubes, thereby forming respective groups of aligned loops thereon, until a desired width is obtained. The ends of the tubular members are unclamped from the holder assembly and weft lengths are formed by pushing or drawing the flexible member through the tubular members. A tube is removed from its position within a corresponding group of aligned loops when the pushed lead end emerges therefrom. The ends of the flexible member are wedged alongside a respective weft length to prevent unravelling of the mat.

20 Claims, 4 Drawing Sheets

HAND WEAVING FRAME FOR FORMING A FLOOR MAT

BACKGROUND OF THE INVENTION

The present invention relates to a method of forming a mat or other floor covering from a rope or other flexible member formed of strands, and an apparatus for performing the same.

Floor coverings, such as rugs or door mats are made using a Wide variety of materials and using a wide variety of techniques. Some mat designs, such as that shown in U.S. Pat. No. 1,686,303, example, utilize a plurality of individual rigid frame members interconnected by flexible strands of yarn or cord. Others, such as that disclosed in U.S. Pat. No. 685,916 to Gawne et al, utilize a woven wire mesh having a length of rope interlaced therein. Such composite designs are often relatively expensive to manufacture since the various materials required may be costly. Further the very features which give them their utility also make them rather unattractive.

Therefore, in order to provide door mats which are sufficiently decorative and aesthetically pleasing, it is still desirable to make available mats and the like which are woven from one or more lengths of rope or other stranded members. Heretofore, however, the manner in which such decorative mats are made has remained essentially unchanged for centuries. Each mat is manually woven by arranging a section of rope into a group of parallel lengths on a flat support surface and then interlocking them by alternately going over and under them with the free end of the rope. As should be readily apparent, the disadvantage of weaving the mat using this technique is that it is very time consuming. Further, the rope ends of mats produced in this manner must be secured by adhesive or by some mechanical fastening means such as a staple or clip to prevent them from becoming "unwoven" during use.

SUMMARY OF THE INVENTION

Accordingly, one of the objects of the present invention is to provide a method for rapidly producing a mat by weaving a single length of rope or similar material, the weave being a simple one and of such nature that a mat of varying dimensions may be produced.

Another object of the invention is to provide an apparatus for use in guiding both the weft and warp lengths of the rope as it is woven, such that the lengths of rope can be arranged quickly and accurately into a uniform and durable mat structure.

With these and other objects in view, as will o more fully hereinafter appear, the method of the present invention comprises the steps of providing a plurality of substantially parallel tubes that are releasably secured by holder means at one end, placing a flexible member such as a rope over a first tube so that a tail end of the flexible member hangs a predetermined distance below the first tube, forming a plurality of substantially parallel warp lengths on the tubes by alternately training a lead section of the flexible member over and under the tubes, beginning with the first tube, such that adjacent warp lengths are trained in opposite directions, releasing the tubes from the holder means with the warp lengths being formed thereon and placing them on a work surface; and inserting a portion of the lead section through each of the tubes to form a plurality of weft lengths, wherein beginning with the first tube, each tube is preferably removed from the warp lengths after an end of the lead section emerges therefrom.

The warp lengths are formed over the tubes by alternately passing the lead section over and under the tubes, adjacent warp lengths being trained in opposite directions, in order to form a group of aligned loops around each tube. In forming the weft lengths, the lead section is preferably moved in a first direction into the first tube. The first tube is removed after the end of the lead section extends beyond a first group of aligned loops, thereby forming a first weft. A portion of lead section is moved in a second direction into a second tube immediately adjacent the first tube and the second tube is removed after the end of the lead section extends beyond a second group of aligned loops, thereby forming a second weft. A portion of the lead section is moved through each remaining tube to form additional weft lengths, adjacent weft lengths being formed by alternating between the first and second directions, wherein each respective tube is removed from a corresponding group of aligned loops after the end of the lead section extends beyond the corresponding group of loops.

During the forming of the warp lengths, the flexible member is preferably drawn from a reel. The flexible member is then cut from the reel to form the end of the lead section which can be inserted into the tubes during the weft forming step. Prior to the cutting step, the desired length of the lead section is selected and measured. The length of the lead section is selected so that the cut end of the lead section hangs a predetermined distance below the last tub after the weft forming step.

During the formation of the weft lengths, the portion of the lead section is preferably pushed through the tubes during the inserting step. The tubes are preferably oriented so that the weft lengths formed therewith are perpendicular to the warp lengths.

The tail end the lead end are placed within respective groups of aligned loops already occupied by a weft length to thus secure them in the mat structure without the use of staples, clips, or other attachment means.

An apparatus for carrying out the method of the present invention comprises a plurality of tubular members and means for releasably securing the tubular members in spaced parallel relation, an end of each tubular member being engaged by the securing means. Preferably, the securing means comprises first and second clamping surfaces and means for changing the distance between the clamping surfaces.

At least one of the clamping surfaces defines a plurality of spaced recesses adapted to receive a surface portion of the tubular members.

DETAILED DESCRIPTION OF THE INVENTION

Figure 1:
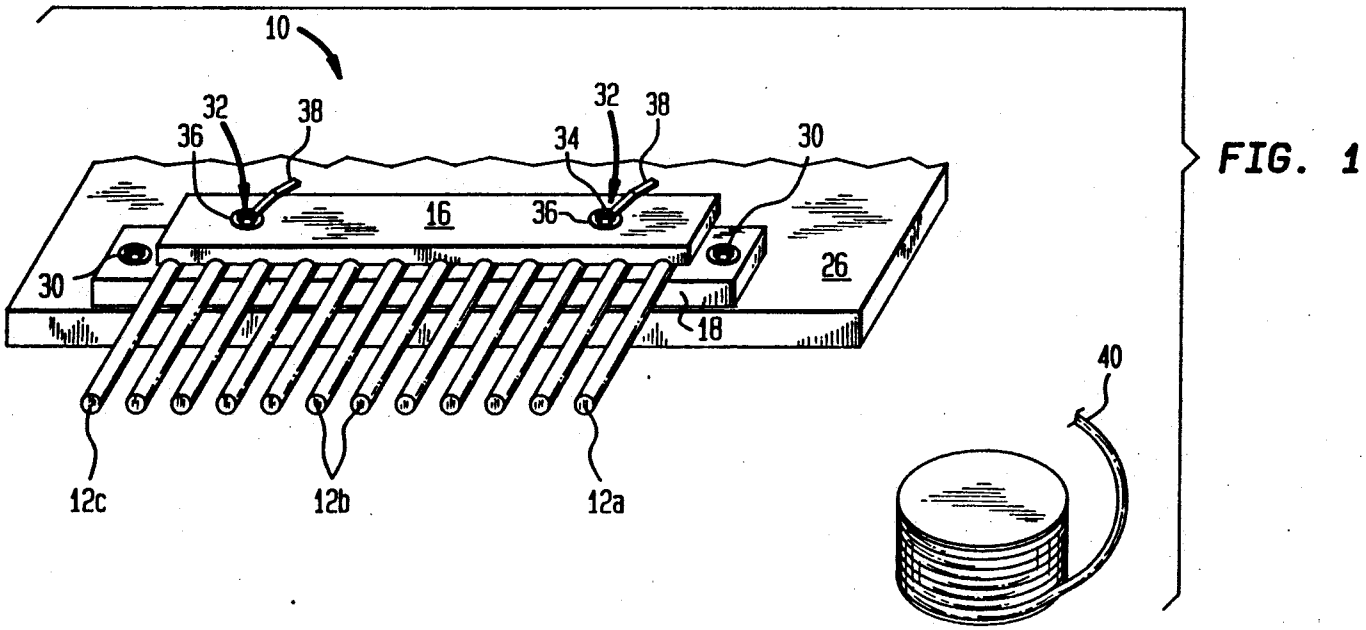
FIG. 1 is a perspective view of the apparatus used for forming a mat in accordance with the present invention.

In the drawings, the inventive mat is illustrated as formed from rope but it should be readily understood that wire cable, strip material, or other elongated flexible materials may be woven in accordance with the method of the present invention if desired. Also, that material may be of any desired diameter. As a matter of convenience, therefore, the word "rope" shall be construed to cover any material suitable for the purpose and capable of being woven by the method and using the apparatus to be hereinafter described.

Referring now to FIG. 1, the apparatus which may be used in performing the method of the present invention is generally identified by the numeral 10 and includes a plurality of elongated tubular members 12 and at least one holder assembly 14 for retaining the tubular members in spaced, parallel relation. For reasons which will be explained below, the interior bore of the tubular members is selected, based on the diameter of the rope to be used in forming a mat, to allow passage of the rope therethrough. As will also be explained, the length of the tubular members controls the width of the mat, while the spacing and number of the tubular members controls the length of the mat.

The holder assembly 14 supports an end of each tubular member and may take a variety of forms. For example, it may comprise a single elongated member having a plurality of spaced, parallel bores and respective set screws for maintaining an end of each tube in a corresponding bore. Preferably, however, the holder assembly comprises an upper holder member 16 and a lower holder member 18 having cooperating aligned recesses for receiving respective tubular members 12.

Figure 3:
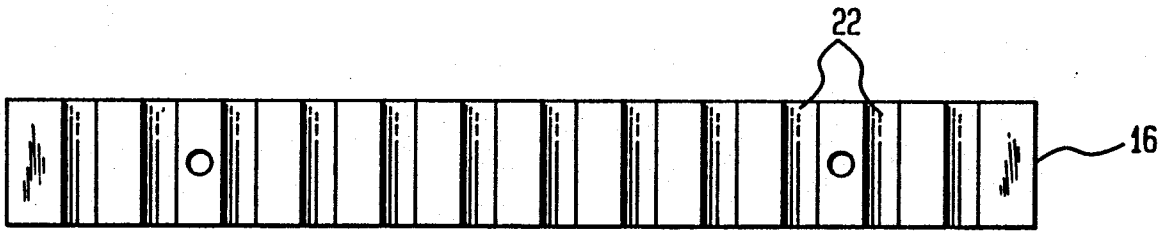
FIG. 3 is a view showing the tubular member engaging surface of a first clamp member of the present invention.
Figure 4:
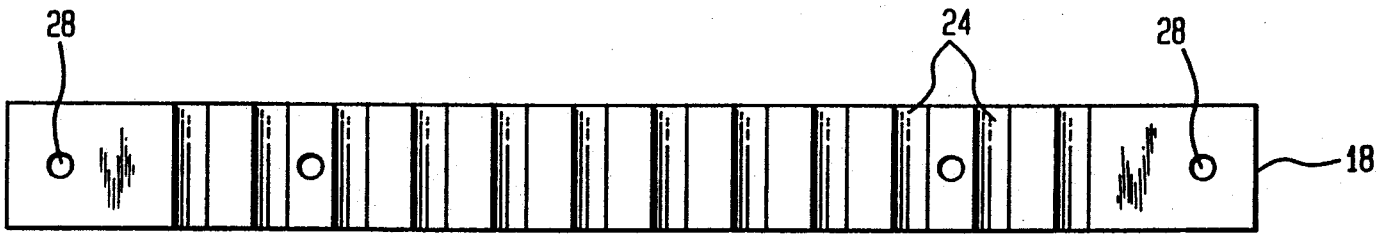
FIG. 4 is a view showing the tubular member engaging surface of a second clamp member of the present invention.

As best seen in FIG. 3, a clamping surface of the upper holder member 16 defines a plurality of parallel recesses 22 which are equally spaced apart and dimensioned to accommodate the upper surfaces of tubular members 12. Similarly, and as shown in FIG. 4, a clamping surface of the lower holder member 18 defines a plurality of parallel recesses 24 which are alignable with recesses 22 and dimensioned to accommodate the lower surfaces of tubular members 12. Preferably, lower holder member 18 is slightly longer than upper holder member 16 so that the apparatus 10 may be secured to a stable work surface 26. The holder assembly may be secured to a work surface in any known manner. For example, the lower holder member may be secured to the work surface using an adhesive bonding agent, or by mechanical means such as C-clamps or the like. In the embodiment shown in FIGS. 1 and 4, mounting holes 28 are provided in the lower holder member to accommodate threaded securing means 30, such as screws or bolts.

Figure 2:
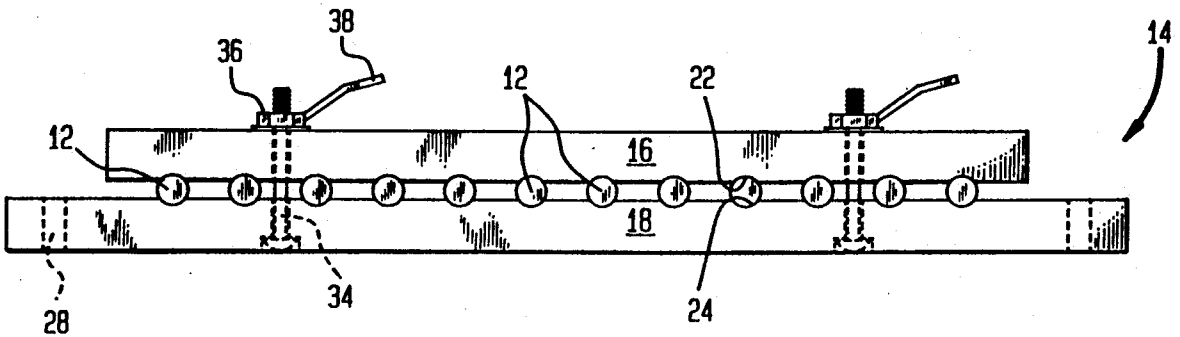
FIG. 2 is a cross sectional view taken along line II—II in FIG. 1.

In order to prevent movement of the tubular members during the weaving process, clamping means 32 hold the upper and lower holder members in aligned relationship as shown in FIG. 2. Any conventional device for clamping two members together may be utilized as the clamping means. For example, a nut and bolt or a C-clamp positioned at opposite ends may be utilized. In the arrangement shown in FIGS. 1 and 2, clamping means 32 comprises a pair of threaded bolts 34 and corresponding modified nut members 36. Each modified nut member 36 includes a handle portion 38 to permit the tubes to be quickly clamped or released between the holder members.

As will be discussed below, the apparatus 10 is most advantageously utilized when the user is facing the open ends of the tubes. Accordingly, only one holder assembly 14 is required and the tubular members 12 are supported in cantilever fashion. However, if desired or if necessary to support the wound rope structure, the tubular members 12 may be supported at both ends by suitable holder members. The tubular members would, of course, need to be mounted sufficiently high enough above the work surface to permit access to the rope above and below the tubes, and in a manner which allows ready disconnection of the tubes therefrom to facilitate the manufacture of the mat as described below.

Figure 5:
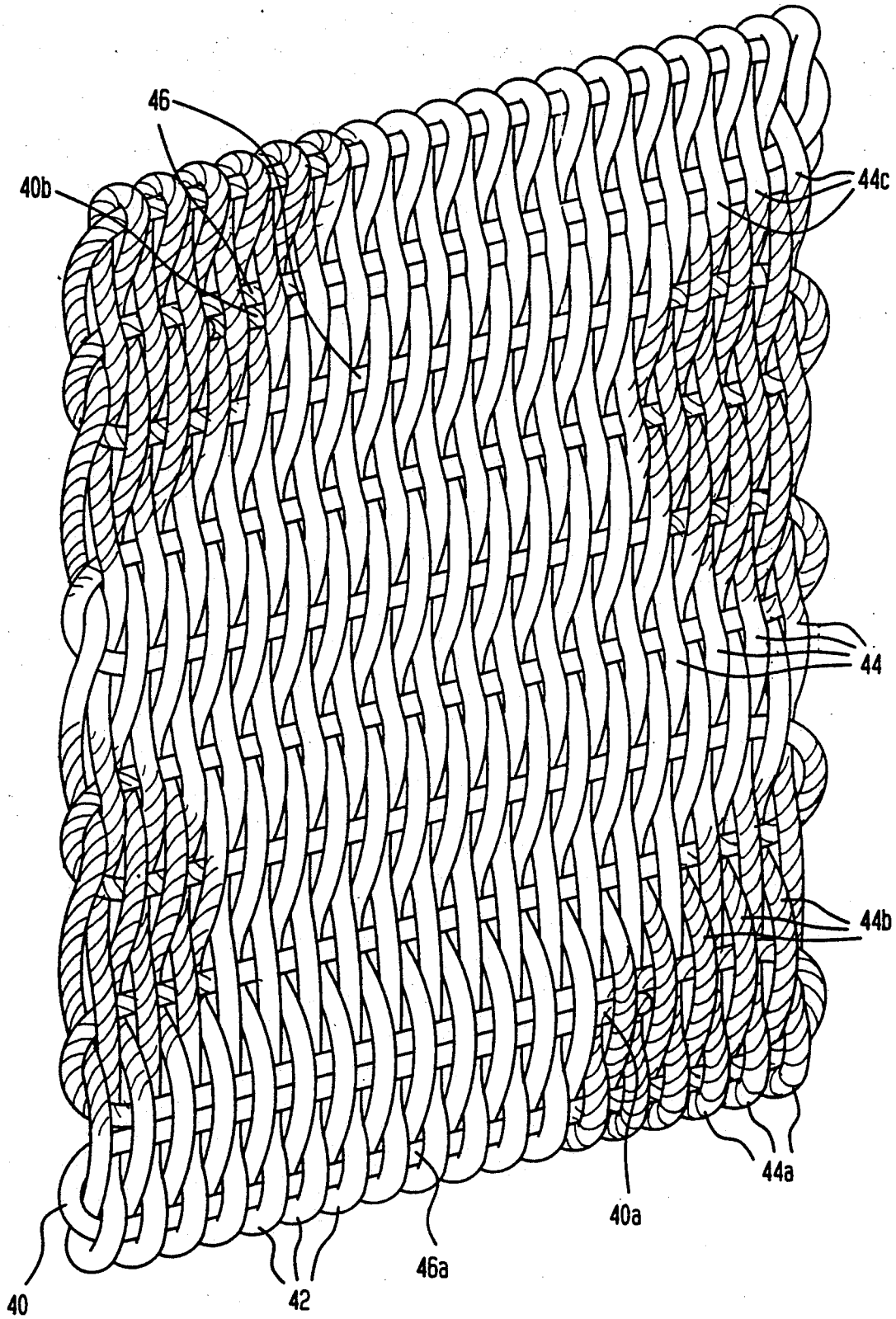
FIG. 5 is a plan view showing a mat completed in accordance with the method of the present invention.
Figure 6:
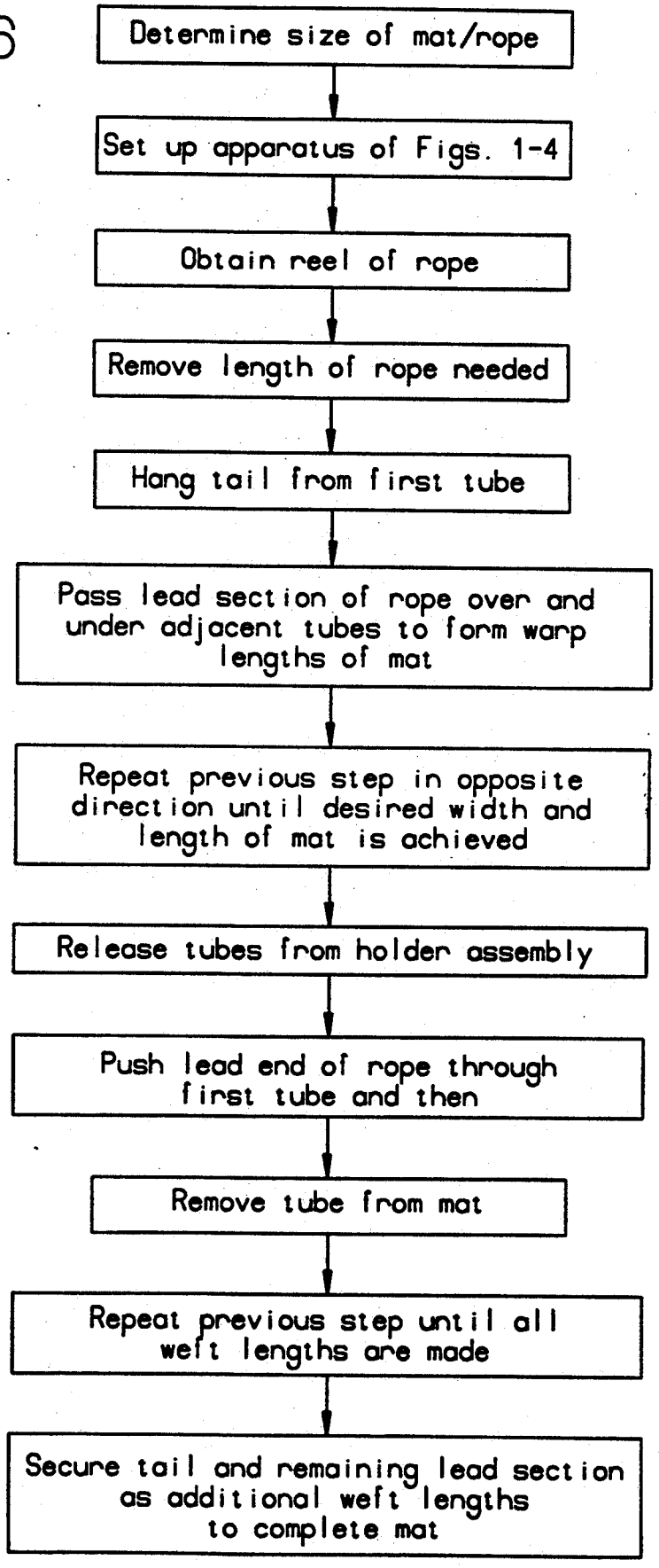
FIG. 6 is a block diagram which illustrates the method steps of the invention.

Referring now to FIGS. 1 and 5, a method of using the apparatus to form a mat from a single length of rope using only one tube holder assembly will now be described. FIG. 6 summarizes the method steps which are used. As best seen in FIG. 5, the warp forming lengths of rope (extending along the length of the mat) interweave with the weft lengths of rope (extending perpendicularly to warp lengths) according to a non-alternating parallel pattern. To produce this pattern, the size of the mat desired is determined. After the size has been determined, the number of hollow tubular members 12 needed to produce the desired size are inserted into the holder assembly 14 so that they are secured in the positions shown in FIG. 1.

Rope 40, which is to be used in producing the mat and which is preferably continuously drawn from a reel for ease of handling, is preferably located adjacent the work surface. The diameter of rope 40 must be smaller than the internal diameter of tubular members 12 so that it may moved therethrough. For purposes of moving rope 40 through tubular members 12, any suitable technique, such as drawing or pushing with a rod or other elongated member, may be employed. Preferably, however, rope 40 is sufficiently stiff to be easily pushed through the pipe by hand. By way of example, a 12 mm (0.47 in) diameter rope made of natural sisal (a vegetable fiber) has been found to be sufficiently stiff to be pushed through a tubular member having an internal diameter of 20 mm (0.79 in) and a length of up to about 685 mm (27 in).

The length of rope 40 required depends upon the center to center spacing of the tubes as well as the mat size desired. To produce a mat having a width of 406 mm (16 in) and a length of 608 mm (24 in) from the 12 mm diameter rope described above and using ten parallel tubular members equally spaced 55 mm (2.17 in) center to center, it has been found that a rope length of approximately 24.7 meters (27 yards) is sufficient. This length may be precut prior to forming the mat. For ease of handling, however, it is preferred that the lead end of the rope be drawn from a reel until cutting is necessary.

Rope 40 is placed over first tube **12*a*, thereby forming a tail end portion 40*a* which hangs a predetermined distance below the first tubular member. Tail end portion 40*a* is secured within the completed mat in a manner which will be explained later. To produce a mat having a width of 355.6 mm (14 in) or larger, it has been found that a tail end portion having a length of about 380 mm (15 in) achieves reliable results. To produce the 406 mm wide mat described above, eighteen warp lengths 42 are formed over first tubular member 12*a*, intermediate tubular members 12*b*, and last tubular member 12*c* by alternately passing the lead section of rope 40** over and under them. Adjacent warp lengths are trained in opposite directions, thereby forming 18 aligned loops 44 around each tubular member.

Prior to forming the weft lengths 46 of the mat in accordance with the steps set forth below, the rope must be cut to the proper length. In the 406 mm by 608 mm wide mat example discussed above, it has been found that approximately 5.3 mm (208 in) are required to complete the mat in accordance with the method steps set forth hereinafter.

The tubes are released from the holder assembly 14 with aligned loops 44 formed thereon and are preferably placed on a work surface. The lead section is pushed in a first direction into and through first tubular member 12*a*. The first weft length 46*a* is formed by removing first tubular member 12*a* after the lead end of rope 40 extends beyond the first group of aligned loops. Preferably, first tubular member 12*a* is removed after the lead end of the rope emerges therefrom. The lead length of rope 40 is then grasped and pulled until no slack remains therein. The lead end of the rope is then pushed into and through the tubular member 12*b* immediately adjacent first tubular member 12*a*, but in a second direction opposite the first. Tubular member 12*b* is removed to form the next weft length. In like fashion, the lead end is pushed through each remaining tubular member to form additional weft lengths, adjacent weft lengths being formed by alternating between the direction of pushing and by removing successive tubular members from respective groups of aligned loops 44 after the lead end of the rope has been pushed therethrough.

The length of the rope should be selected so that after the lead end of rope 40 has been pushed through the last tubular member 12*c*, a lead end portion 40*b* still remains. A length of about 380 mm (15 in) has also been found satisfactory for lead end portion 40*b*. It is noted that end portions 40*a* and 40*b* could be made shorter and fused, adhesively joined, or mechanically fastened to respective sections of rope 40. However, by utilizing lengthier end portions 40*a* and 40*b*, the present method avoids the additional labor and material required by such joining techniques.

Specifically, end portions 40*a* and 40*b* are pushed through respective groups of aligned loops 44*b* and 44*c* on either end of the mat. Since loop groups 44*b* and 44*c* already contain a weft length, an elongated member such as a rod may be used to wedge the end portions into position and thus, secure them to the structure without additional attachment means.

To facilitate the pushing of the lead end of the rope through the tubes and to prevent unraveling of the lead end when a multiple fiber rope is used, the lead end may be provided with a clip or wrapping, as is well known in the art. A plastic- member such as one similar to that used on the ends of shoelaces can also be used. The same type device can be placed on the tail end of the rope for the same reasons.

Although the disclosure describes and illustrates a particular embodiment of an apparatus for performing the method of the present invention, it is to be understood that the invention is not restricted to this particular embodiment.

For example, the warps can be formed by winding the rope over and under more than one tube, while the wefts can be formed by passing the rope subsequently through tubes that are not adjacent.

What is claimed is:

1. A method of weaving a mat from an elongated flexible member comprising the steps of:

providing a plurality of substantially parallel tubes, said tubes being releasably secured at one end by holder means;

placing a flexible member having a lead end and a tail end over a first of said tubes so that said tail end of said flexible member hangs a predetermined distance below said first tube;

forming a plurality of substantially parallel warp lengths on said tubes by alternately training a first section of said flexible member over and under said tubes, adjacent warp lengths being trained in opposite directions;

releasing the ends of said tubes from said holder means with said warp lengths formed thereon; and passing said lead end of the flexible member through each of said tubes to form a plurality of weft lengths from a second section of the flexible member, wherein each tube is removed from said warp lengths after said lead end emerges therefrom.

2. The method of claim 1, further including the step of obtaining said predetermined distance by measuring said tail end prior to said placing step.

3. The method of claim 1 further including the step of pushing a portion of said second flexible member section through said tubes during said passing step.

4. The method of claim 1 further including the step of forming said weft lengths substantially perpendicular to said warp lengths.

5. The method of claim 1, further including the step of training said warp lengths in directions transverse to the longitudinal axes of said tubes.

6. The method of claim 1, further including the step of drawing the flexible member from a reel during said warp length forming step.

7. The method of claim 6, further including cutting the flexible member to form said lead end after said warp length forming step.

8. The method of claim 7, further including selecting a predetermined length of said second flexible member section prior to said cutting step.

9. The method of claim 8, further including the step of selecting said predetermined length so that said lead end hangs a predetermined distance below a last of said tubes after said weft forming step.

10. The method of claim 9, further including the step of placing said tail end and said lead end between said warp lengths after said weft lengths are formed.

11. The method of claim 10, further including the step of placing said tail end and lead end adjacent a first and a last warp length, respectively.

12. The method of claim 1, further including the step of placing the first flexible member section over and under immediately adjacent tubes.

13. A method of weaving a mat from a flexible member comprising the steps of:

providing a plurality of substantially parallel tubes, said tubes being releasably secured at one end by holder means;

placing a flexible member having a lead end and a tail end over a first of said tubes so that said tail end of the flexible member hangs below said first tube;

forming a plurality of warp lengths over said tubes by alternately passing a first section of said flexible member over and under each adjacent tube, adjacent warp lengths being trained in opposite directions, thereby forming a group of aligned loops around each tube;

releasing the ends of said tubes from said holder means with said aligned loops formed thereon; and passing said lead end of the flexible member through each of said tubes to form a plurality of weft lengths from a second section of the flexible member, wherein each tube is removed from said warp lengths after said lead end emerges therefrom.

14. The method of claim 13, further including the step of pushing a portion of said second flexible member section through the tubes during said passing step.

15. The method of claim 13, further including selecting a predetermined length of said first and second flexible member sections and cutting said flexible member to obtain said predetermined length.

16. The method of claim 15, further including the step of cutting said second flexible member section after said warp length forming step.

17. The method of claim 15, further including the step of selecting said predetermined length so that the lead end hangs a predetermined distance below a last of said tubes after all of said weft lengths are formed.

18. The method of claim 13, further including the step of placing said tail end and said lead end within respective groups aligned loops already occupied by a weft length and adjacent a first and a last weft length, respectively.

19. An apparatus for weaving a mat from a single flexible member comprising:

a plurality of tubular members each having an outer surface, first and second ends and an open interior bore for passage of the flexible member therethrough;

means for releasably securing said first ends of the tubular members in spaced parallel relation, said securing means comprising first and second clamping surfaces for releasably engaging the outer surfaces of the tubular members; and means for changing the distance between said clamping surfaces to as to easily secure and release said first ends of the tubular members.

20. The apparatus of claim 19, wherein at least one of said clamping surfaces defines a plurality of spaced recesses adapted to receive said first ends of the tubular members.

* * * * *